United States Patent [19]

Heeren et al.

[11] 4,206,738

[45] Jun. 10, 1980

[54] HEAT EXCHANGER

[75] Inventors: Hermann Heeren, Nuremberg; Liselotte Kraetschmer, Hanover, both of Fed. Rep. of Germany

[73] Assignee: Maschinenfabrik Augsburg-Nürnberg Aktiengesellschaft, Nuremberg, Fed. Rep. of Germany

[21] Appl. No.: 780,280

[22] Filed: Mar. 23, 1977

[30] Foreign Application Priority Data

| | | | |
|---|---|---|---|
| Mar. 23, 1976 | [DE] | Fed. Rep. of Germany | 2612158 |
| Feb. 25, 1977 | [DE] | Fed. Rep. of Germany | 2708162 |
| Feb. 25, 1977 | [DE] | Fed. Rep. of Germany | 2708163 |

[51] Int. Cl.[2] ..... F28F 3/08; F28D 1/06

[52] U.S. Cl. ..... 165/148; 165/DIG. 1; 165/166

[58] Field of Search ..... 165/148, DIG. 1, 150, 165/160, 164–166

[56] References Cited

U.S. PATENT DOCUMENTS

| | | | |
|---|---|---|---|
| 1,086,061 | 2/1914 | Kurtzner | 165/148 |
| 1,296,058 | 3/1919 | Fedders | 165/148 |
| 1,338,753 | 5/1920 | Sosskin | 165/148 |
| 1,410,356 | 3/1922 | Wolf | 165/148 |
| 1,683,340 | 9/1928 | Fedders | 165/148 |
| 2,568,984 | 9/1951 | Bowsher | 165/148 |
| 2,577,123 | 12/1951 | Hitchens et al. | 165/148 X |
| 2,577,124 | 12/1951 | Newcomer | 165/148 X |
| 3,995,689 | 12/1976 | Cates | 165/DIG. 1 |

*Primary Examiner*—Ira S. Lazarus

*Attorney, Agent, or Firm*—Becker & Becker, Inc.

[57] ABSTRACT

A heat exchanger for indirect recooling of a heat transfer medium, such as water, by air. The heat transfer medium has a relatively high heat transfer coefficient compared to that of air. The heat exchanger has two substantially parallel end walls or plates which are provided with holes. Associated with these end walls are side walls which are provided with inlet and outlet means for the heat transfer medium. Non-finned tubes with air flowing therethrough are disposed between the end walls and are sealed thereagainst.

9 Claims, 14 Drawing Figures

Figure 1:
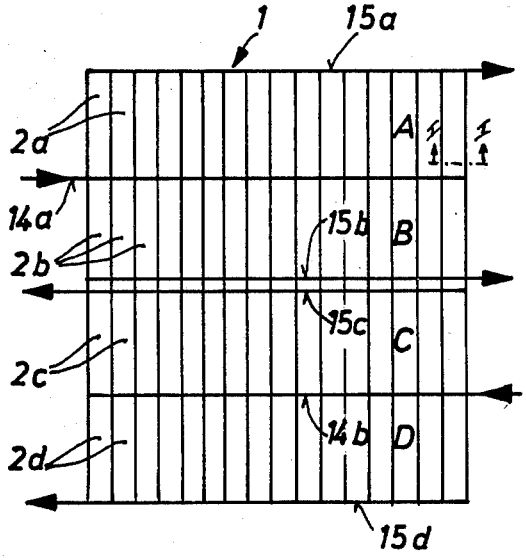

SPECIFIC HEAT RATE
$k_A$
1000
3000 $\frac{W}{m^2K}$
2000
1000
0
0
10
20
30
50
70
100 m
TOWER SHELL HEIGHT H
$\delta_1$
$\delta_2$
$\delta_3$
$\delta_4$
$\delta_5$
$\delta_6$

HEAT EXCHANGER

The invention relates to a heat exchanger for the indirect recooling of a heat transfer medium, e.g. water, by air, where the heat transfer medium has a relatively high heat transfer coefficient compared to that of air.

It has been known to pass water to be recooled through cooling tube bundles the tubes of which have air flowing across them. The surface of the tubes in contact with the air is generally extended by means of ribs or fins with the object of making the product ($\alpha_L \cdot A_L$) of heat transfer coefficient times the allied surface area at the air side governing heat transfer as closely equal to the corresponding product ($\alpha_W \cdot A_W$) at the water side. The approach of the aforementioned products is, however, subject to limitations because, as the ratio $A_L/A_W$ (A=area) increases, the distance between the fins has to be decreased and/or the height of the fins increased, whereby both the flow losses at the air side and the losses due to heat conduction through the fins to the core tube tend to increase. Both factors reduce the efficiency and, thereby, the heat transfer rate of the tube.

In order to be able to transfer equal amounts of heat, dry cooling towers, for example, are required to be of larger size than wet cooling towers. While a reduction in size has been achieved by the use of the aforementioned extended surfaces at the air side, sizes are still considerable.

This invention has for its object to create an easy-to-manufacture heat exchanger which offers a minimum air side resistance and affords the possibility to achieve an optimum ratio ($A_{W\ddot{u}} \cdot \alpha_{W\ddot{u}}$)/($A_L \cdot \alpha_L$) ($A_{W\ddot{u}}$ and $A_L$ denote the heat transfer areas at the side of the heat transfer medium and at the air side; $\alpha_{W\ddot{u}}$ and $\alpha_L$ denote the allied heat transfer coefficients).

According to the invention, this problem is solved by means of two parallel end walls having holes and allied side walls with inlet and outlet for the heat transfer medium as well as non-finned tubes with air flowing inside arranged between and sealed in said end walls.

The heat exchanger according to the invention permits the area in contact with air to be extended arbitrarily without the use of fins by increasing the tube length; there are no additional losses on account of heat conduction; on the contrary, these are reduced because the specific heat flux per unit area diminishes as tube length is increased. With a given air-contacted surface and a given air side flow resistance—firstly for the external fin tube and secondly for the heat exchanger according to the invention—a much higher heat transfer rate is obtained on the strength of the physical differences with the heat exchanger according to the invention; an added factor being that the increase in air-contacted surface is accompanied by a proportionate increase in water-contacted surface; this plus the possibility of better utilization of the tower cross sectional area affords another improvement in heat transfer rate.

An advantageous development of the invention applied to a heat exchanger with the draught-generating shell of a cooling tower or similar configuration consists in adopting the relation $$k_A = 382 \cdot L^{0.48} \cdot \left[ H \cdot \frac{(\gamma_1 - \gamma_2)}{0{,}1} \right]^{0.53}$$

in designing the cooling tower and selecting the length L of the tubes greater than or equal to 0.8 meters. In this expression the symbols used have the following meanings:

L=length of tubes in meters

H=height of tower shell in meters $\gamma_1$=specific gravity of air directly at inlet into heat exchanger in kg/m$^3$ $\gamma_2$=specific gravity of air at the level of the tower shell top in kg/m$^3$ $k_A$=specific heat transfer rate in W/m$^2$K (Watts p. sq. meter of area of attack and degree Kelvin), where "area of attack" is defined as the projected area of the heat exchanger looking in the direction of the on-flowing air directly in front of the heat exchanger.

A cooling tower (heat exchanger) designed on these lines offers advantages in comparison to certain known designs using finned tubes especially with respect to tower dimensions or heat transfer rate.

According to further features of the invention, exceptionally favourable conditions can be obtained by adopting an inside diameter of the tubes between 10 millimeters and 50 millimeters and/or a wall thickness of tubes of 0.3 millimeters to 1 millimeter and/or, where a liquid heat transfer medium is used, a clear distance between the tubes between 0.5 millimeters and 2 millimeters. Where used for the condensation of vapour-state heat transfer media, the clear distance between the tubes outside the necessary tubeless vapour lanes is preferably between 2 millimeters and 5 millimeters.

In order to produce a favorable flow for heat transfer in the heat exchange element or elements of the heat exchanger, passages are formed inside the element or each element by means of one or several partitions to guide a liquid heat transfer medium so that said medium is guided in the fashion of cooling coils.

If the heat exchanger according to the invention is made with a plurality of elements, then the elements are preferably arranged side by side and/or on top of each other.

In another embodiment of the invention, the tubes are extended at their ends to form a hexagon with the edges or sides of the hexagons being attached to each other in a manner sealing off the heat transfer medium to form the end walls. This feature offers advantages especially with respect to fabrication of the relevant parts of the heat exchanger.

A further reduction of tower sizes or an increase in heat transfer rate is attained if, according to another feature of the invention, turbulence-inducing means are provided in the tubes through which the air flows.

Figure 2:
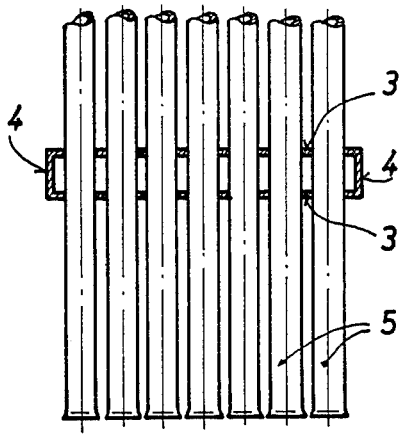
Figure 3:
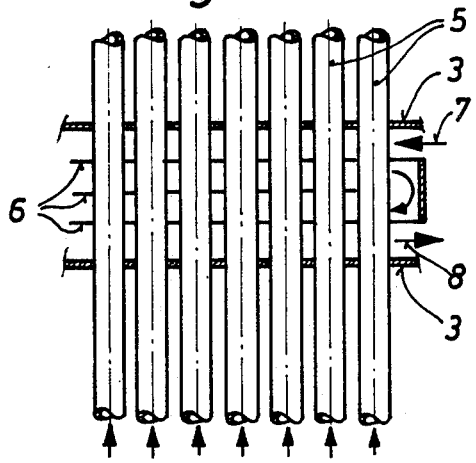
Figure 5:
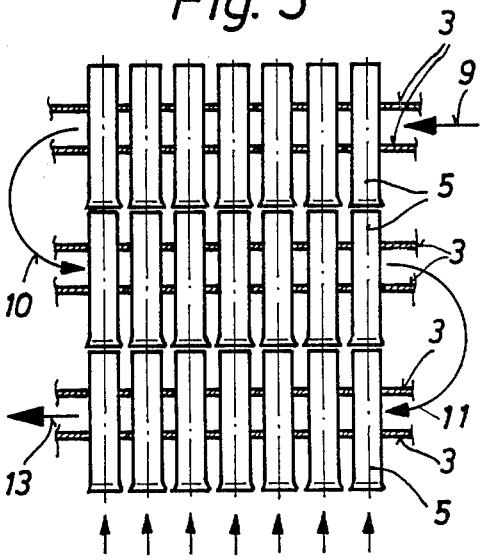
Figure 4:
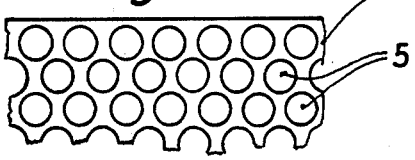
Figure 6:
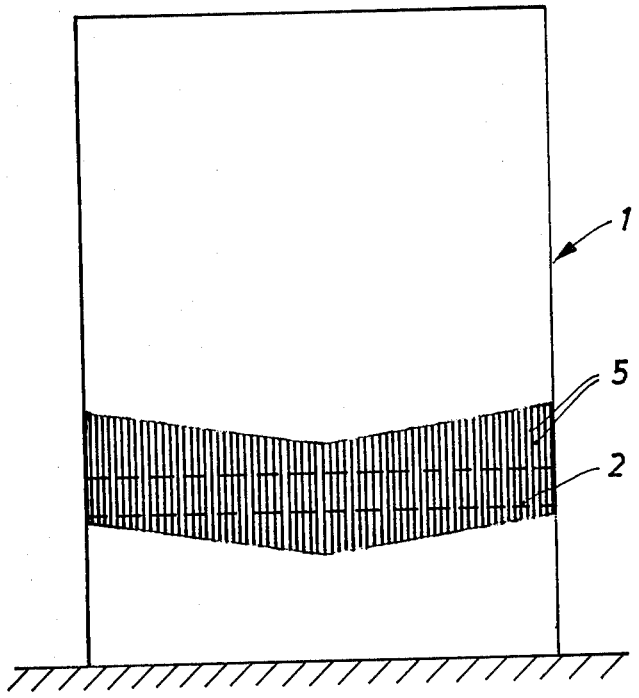
Figure 7:
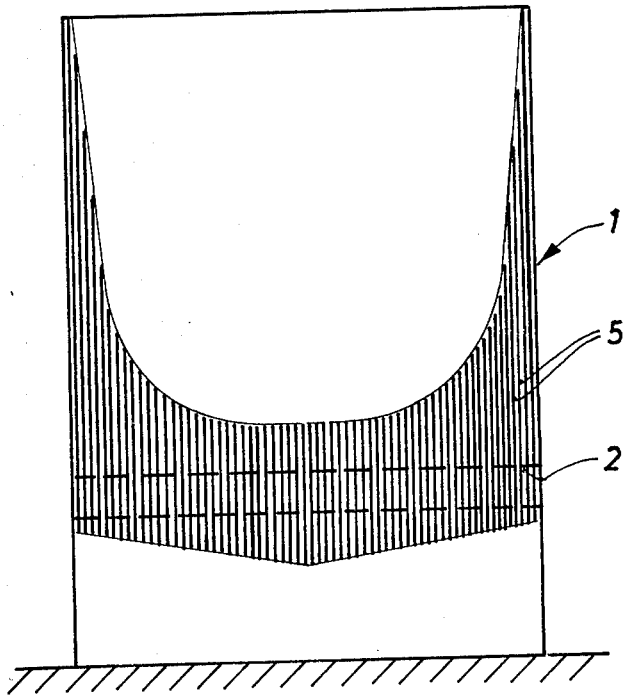
Figure 8:
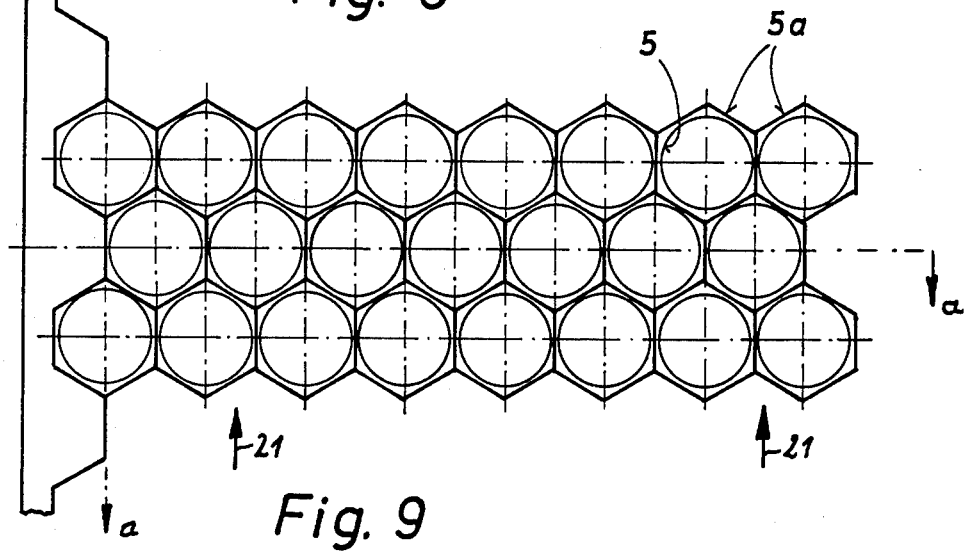
Figure 9:
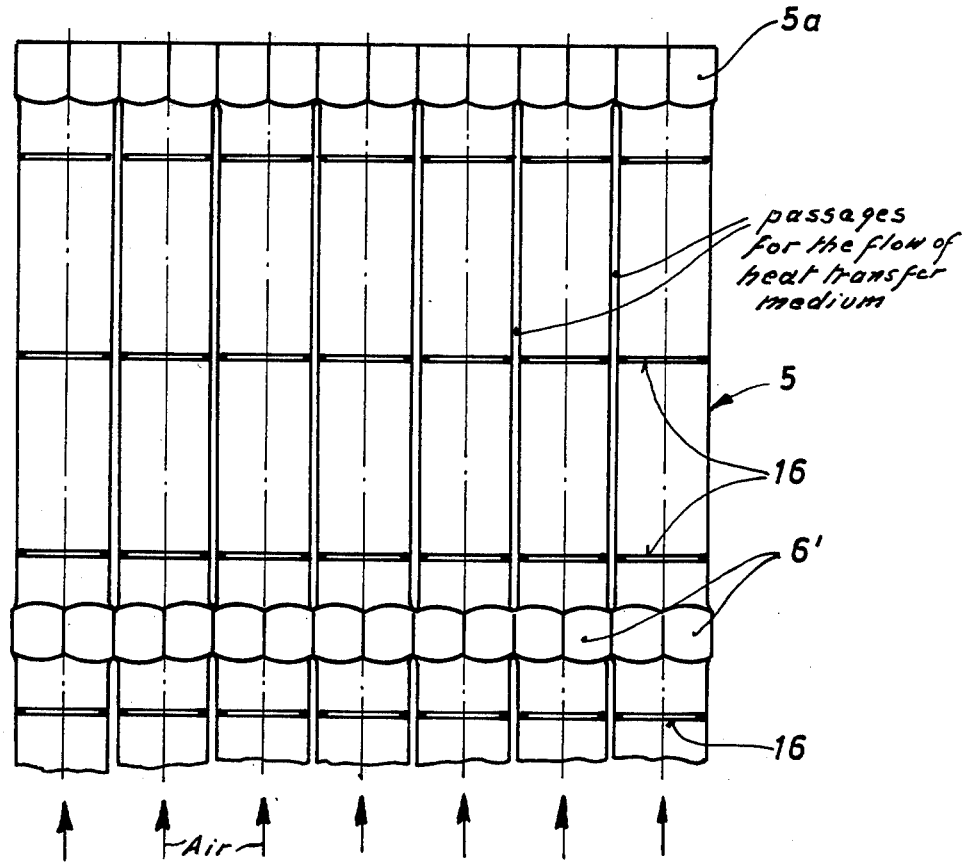
Figure 11:
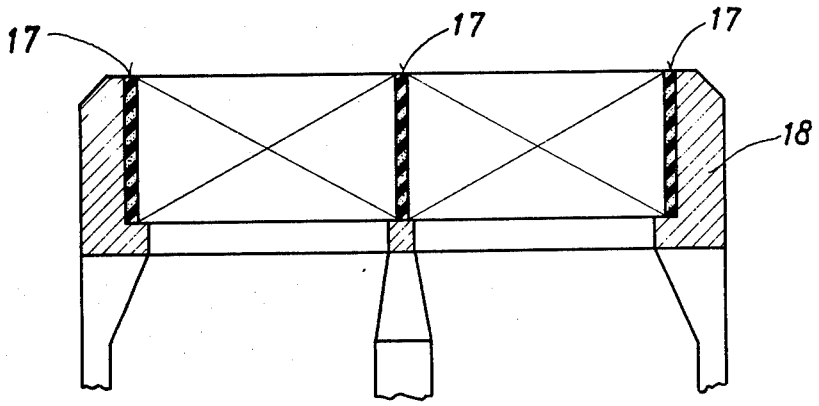
Figure 10:
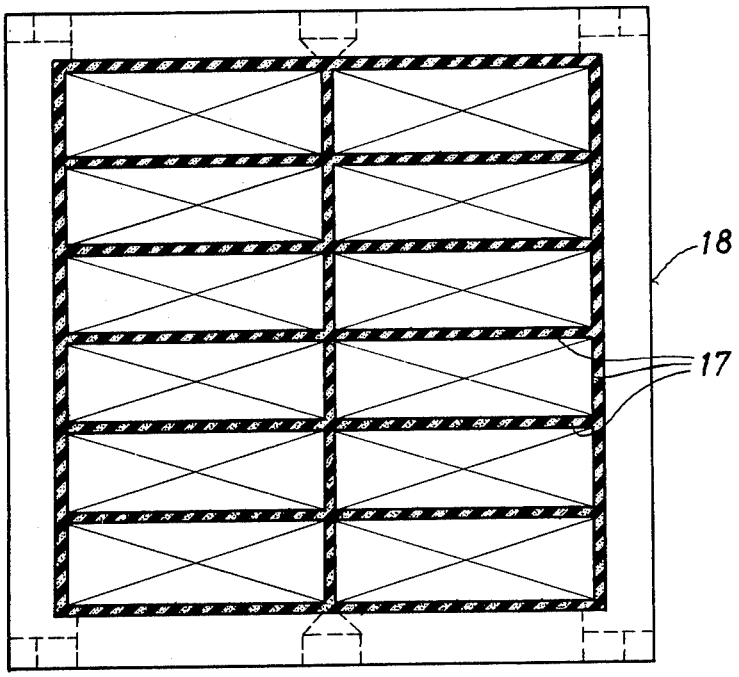
Figure 12:
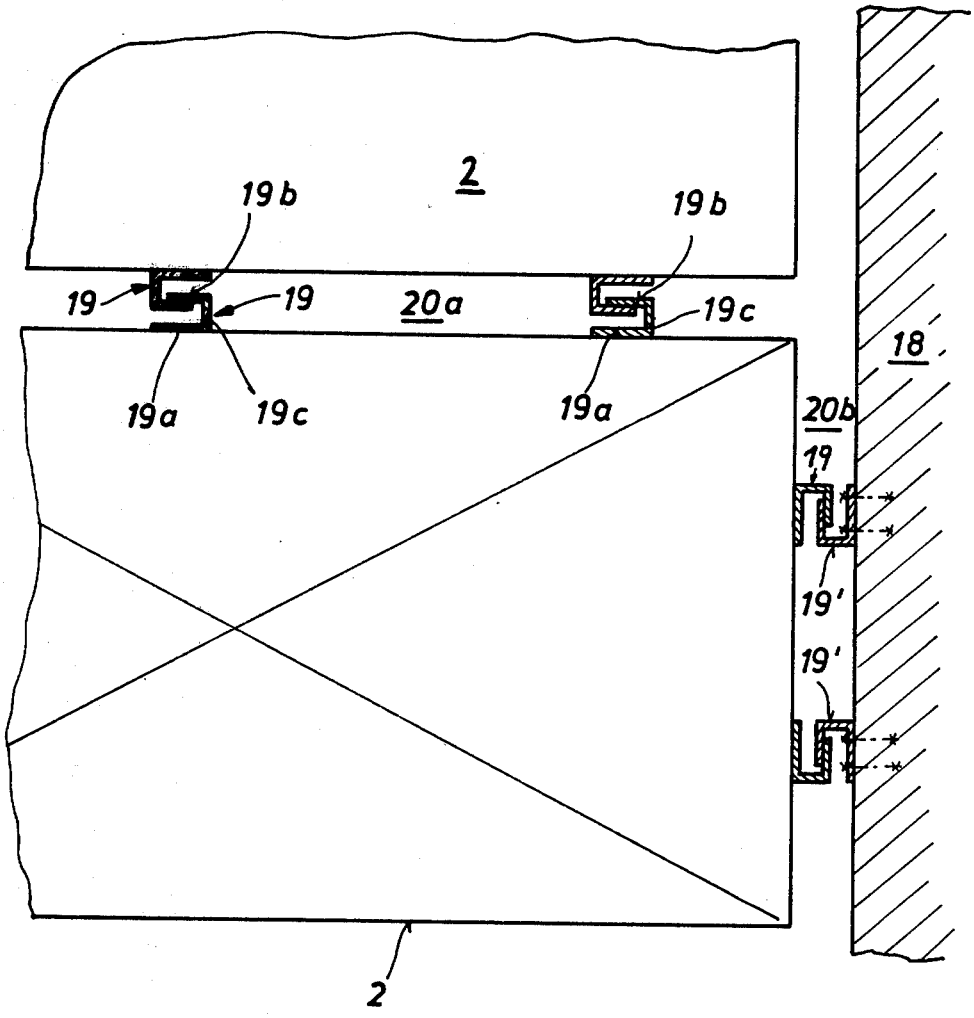
Figure 13:
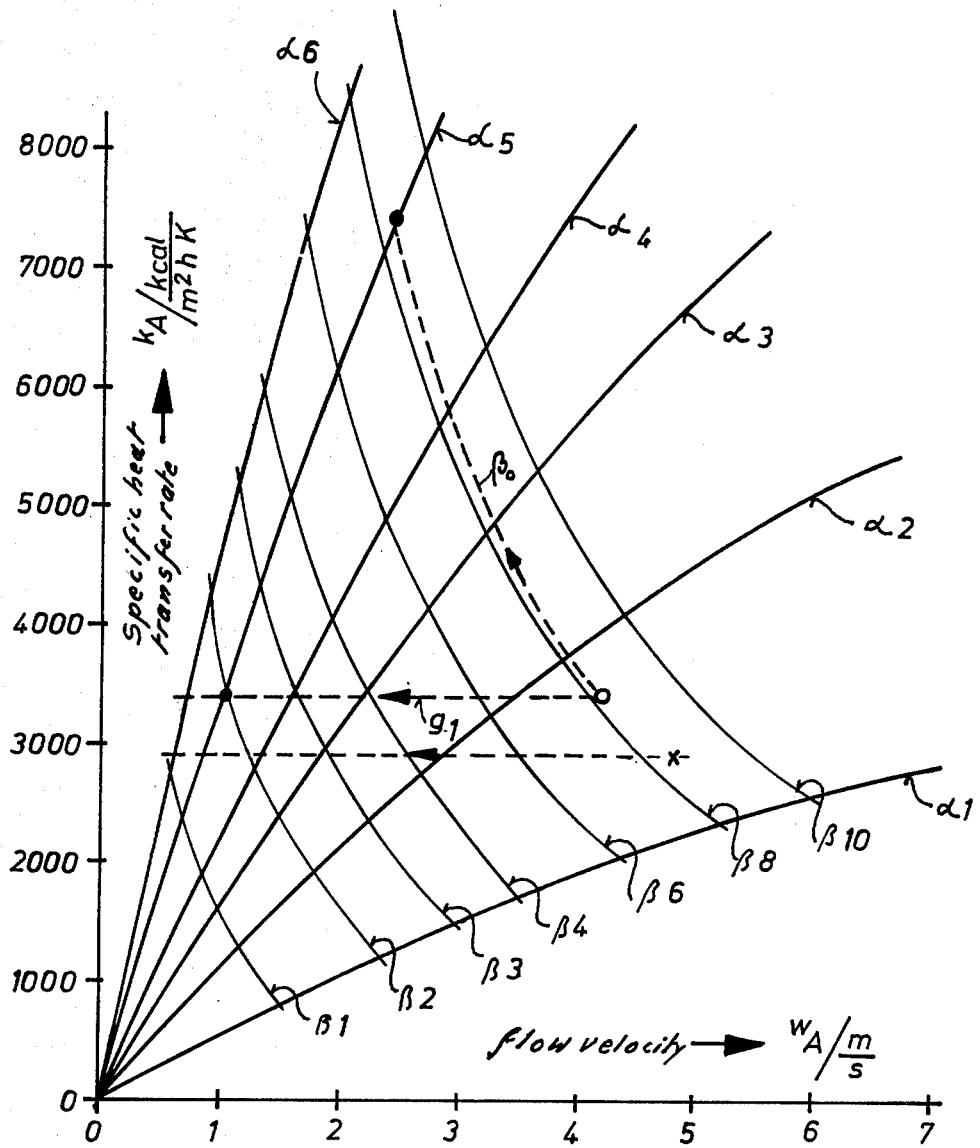
Figure 14:
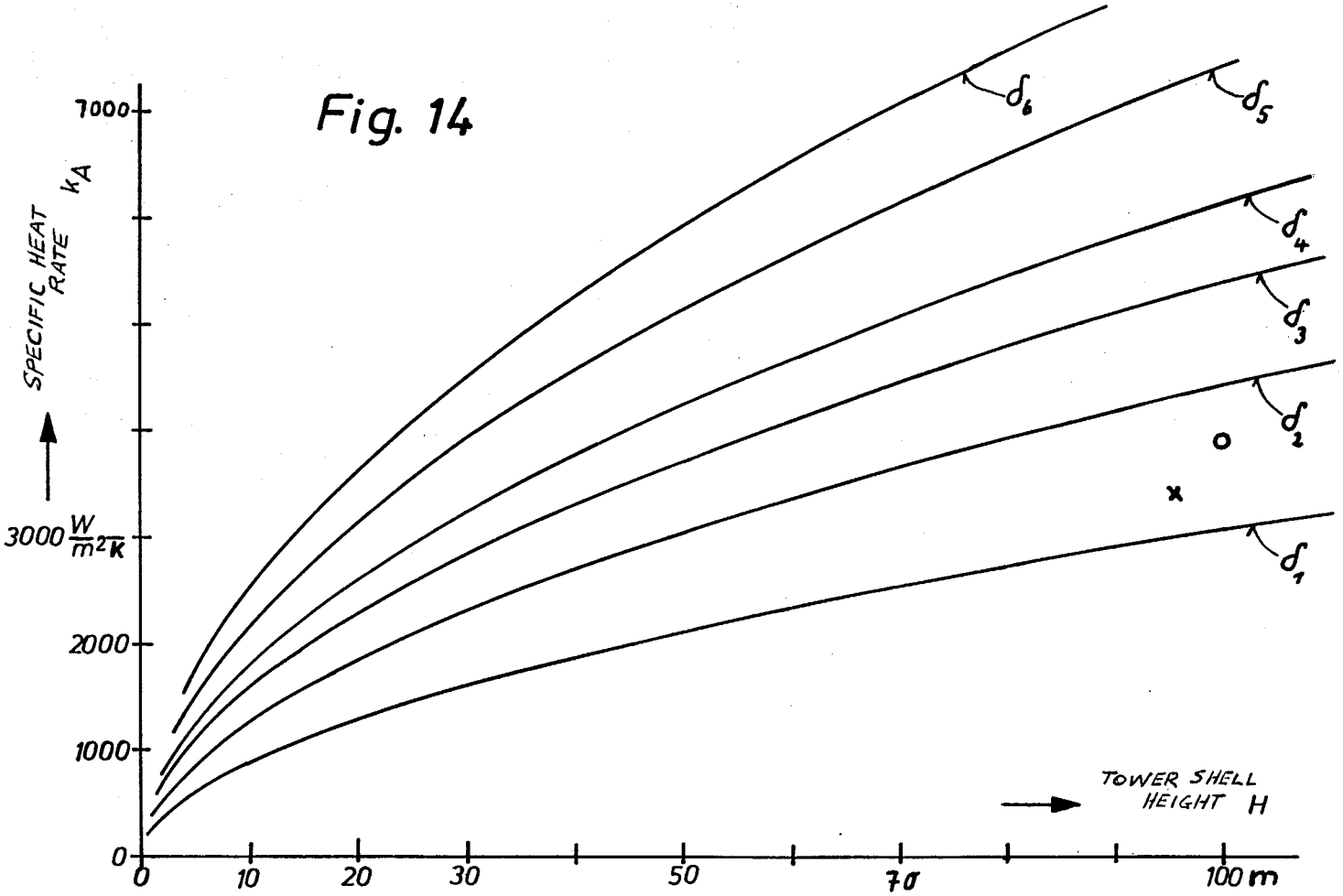

The heat exchanger according to the invention is schematically shown, partly in conjunction with a dry cooling tower for dissipating the heat of condensation in larger size power stations to the air in the accompanying drawing wherein:

FIG. 1 is a plan view of a dry cooling tower including the built-in heat exchange equipment, FIG. 2 shows one of the heat exchange elements in a cross section along the line I—I in FIG. 1, but on a larger scale, FIG. 3 is a part view of a longitudinal section through a heat exchange element, FIG. 4 is a plan view of the heat exchange element part shown in FIG. 3, FIG. 5 is a part view of a longitudinal section through a variant of the heat exchange element shown in FIG. 3, FIG. 6 is a longitudinal section through a dry cooling tower, FIG. 7 is a longitudinal section through a dry cooling tower with a different tubing arrangement for the air compared to FIG. 6, FIG. 8 is a plan view of a part of a heat exchange element according to the invention, FIG. 9 is a section along the line a—a in FIG. 8, FIG. 10 is a horizontal section through the cooling tower at a level a short distance above the heat exchange elements, FIG. 11 is a part view of a central longitudinal section through the cooling tower, FIG. 12 is a part view of a horizontal section through the cooling tower at a level a short distance above the heat exchange elements, FIG. 13 is a family of characteristic curves of the heat exchanger according to the invention, and FIG. 14 is another graph of the heat exchanger according to the invention.

A dry cooling tower 1 for the dissipation of the heat of condensation in large steam power stations—for reasons of convenient shipment and handling of the heat exchange elements—is constructed with a substantial number of heat exchange elements 2 inside the tower connected to an inlet pipe and an outlet pipe. The heat exchange elements 2 all have the same components; therefore, only one of the heat exchange elements is described in detail in the following.

Each heat exchange element 2 has two plates 3 arranged at a distance from each other and on top of each other. The plates 3 may be disposed horizontally or inclined. The two plates 3 together with the side walls 4 form a passage in which is conducted, preferably in a recooling application, the heat transfer medium having a high heat transfer coefficient relative to air, preferably water. The heat transfer medium enters at one of the ends into the passage and leaves at the other end. The plates 3 are provided with holes through which penetrate vertical tubes 5 consisting of a material having a high heat conductivity, e.g. aluminum, and through which air is passed upwardly from the bottom. The tubes 5 which have a smooth outer surface and the holes in the plates 3 are in contact and form a tight seal so that no heat transfer medium can leak out. The tubes 5 project beyond the upper plate 3 and the lower plate 3. The most favorable distance of the passage formed by plates 3 and side walls 4 with respect to the ratio ($A_{WÜ} \cdot \alpha_{WÜ} / A_L \cdot \alpha_L$) from the air inlet into the tubes 5 is established from straightforward optimizing calculations. The most favorable distance varies for different materials used for the tubes 5.

Intermediate plates 6 may be provided between the plates 3 parallel to the latter and serving for the guidance of the heat transfer medium. In FIG. 3 there are three intermediate plates 6 arranged so that four equal cross sectional areas are obtained for the heat transfer medium flowing through. The heat transfer medium enters at 7 into the upper passage to be deflected inside the heat exchange element at each end of the passage, being guided in the fashion of a cooling coil and leaves the lower passage at 8.

Instead of sub-dividing a passage of a greater height of the type shown in FIG. 3 by intermediate plates 6 into several passages of lower heights, it is also possible as shown in FIG. 5 to arrange a plurality of separate passages (without intermediate plates) of low height at a distance above each other. In FIG. 5 three passages are shown above each other. The heat transfer medium enters at 9 into the upper passages to be deflected at the end of this passage and to enter into the middle passage at 10 and is again deflected at the end of this passage to flow into the lower passage at 11 and to leave the lower passage at 13.

The heat transfer from the heat transfer medium to the tubes 5 is effected via the part of the tubes situated between the plates 3 and from the complete tube inner surface to the air.

The heat transfer area per passage element at the heat transfer medium side is:

$$A_{WU} = d_a \cdot \pi \cdot b \cdot z$$

where $d_a$ = tube outside diameter b = plate spacing z = number of tubes $\pi = 3.14159$.

The heat transfer area per passage element at the air side in the case of tubes without internal finning is:

$$A_L = d_i \cdot \pi \cdot l \cdot z$$

where $d_i$ = tube inside diameter l = tube length z = number of tubes $\pi = 3.14159$.

A reduction in cost is achieved if according to FIG. 7 the proportion of tubes 5 situated above the heat exchange elements is made to increase from the inside of the tower towards its outside in a manner that the outermost tube row forms part of the shell of the cooling tower. The outermost tubes are either placed in contact with each other or they are spaced apart and the interstices filled with suitable means for reasons of tightness and strength. The tube rows support each other mutually because they gradually increase in height from the inside towards the outside.

In order to create improved inlet conditions for the air, the distance between the lower edge of the tubes and the cooling tower floor increases as the distance from the tower centre increases (see FIGS. 6 and 7).

If, for example, the cooling tower has a square cross section and if, looking in the direction of the heat exchange elements, four heat exchange elements 2*a*, 2*b*, 2*c*, 2*d* each are arranged in series, then the admission of the heat exchange medium to be cooled is, for example, via two pipes 14*a*, 14*b* which run perpendicular to the longitudinal axis of the heat exchange elements. The two pipes 14*a*, 14*b* each run between two opposite ends to feed all elements of the four rows, A, B, C, D. The pipe 14*a* feeds the two rows A and B; the pipe 14*b* the rows C and D. The discharge of the heat transfer medium from the heat exchange elements is via pipes 15*a*, 15*b*, 15*c* and 15*d* which also run across the longitudinal axes of the heat exchange elements, but at the ends opposite to the admission side. The pipes 15*a* to 15*d* are connected to the outlet openings of all heat exchange elements 2.

In the case of horizontally arranged plates 3, the plates are preferably formed in a manner that the ends of the tubes 5 are extended to form a hexagon 5a and that the edges of the hexagons are welded, soldered, glued or otherwise tightly bonded to each other. FIG. 8 shows a part view of the plan view of a heat exchange element constructed in this manner; the arrows 21 indicate the flow direction of the heat transfer medium.

The heat exchange elements 2 are preferably matched with their base area (length x width) to suit transport facilities; the height of the heat exchange elements is given by the necessities of thermal design. The material for the heat exchange elements 2 may, for example, be aluminum, brass, alloy steel and carbon steel.

With the air flowing through the tubes 5, boundary layer will form after a certain inlet section and the thickness of these boundary layers will increase as the distance from the tube inlet opening increases. In order to improve heat transfer, helical bodies, pressed-in thin wires in the form of rings or similar means known per se are used in the tubes. The said means serve to influence the boundary layer and act as turbulence-inducing means. FIG. 9 shows turbulence-inducing means which are denoted by the numeral 16.

The side walls 4—i.e. all walls with the exception of the lower and upper sides formed by plates 3—of the box-shaped heat exchange elements 2 may be constructed to be flexurally soft. In this case, it is necessary to arrange the heat exchange elements with an interspace relative to each other and relative to the cooling tower inner wall and, secondly, to construct the frame structure 18 (FIG. 11) of the cooling tower in the zone where the heat exchange elements are arranged with flexural stiffness. The flexurally stiff frame structure 18 serves for the support and lateral stabilization of the heat exchange elements; the frame structure may, for example, be made of concrete. The interspaces between the side walls of the heat exchange elements and the corresponding side walls of the heat exchange elements and the cooling tower inner wall are filled with a pressure-resistant filling 17, e.g. a suitable foamed plastic.

If the heat transfer medium flowing through the heat exchange elements 2 is at a pressure lower than that exerted by the air from the outside onto the heat exchange elements, then the side walls 4 of the heat exchange elements 2 are arranged with interspaces 20a relative to each other and with interspaces 20b relative to the cooling tower inner wall and provided with vertical continuous sections 19 which, for example, may be connected to welds to the corresponding side walls 4. The sections used may, as shown in FIG. 12, be for example sections of the [or] type. The sections 19 referred to have two legs 19a, 19b which are parallel to the side wall 4 of the heat exchange elements and interconnected at one side by a web 19c disposed perpendicular to the legs. Adjacent heat exchange elements 2 are connected via these sections 19 in a force-locking manner so that the forces caused in the side surfaces of the heat exchange elements due to the negative pressure are balanced out. The frame structure 18, which may, for example, consist of concrete, and which in this case has to be designed with flexural stiffness, is also provided with such sections 19' ([or] sections); these sections 19' are connected in a force-locking manner with the corresponding sections 19 of the adjacent side walls of the heat exchange elements so tht the tensile forces caused by the negative pressure are transmitted to the frame structure 18. The interspaces 20a between the side walls 4 of adjacent heat exchange elements 2 and the interspaces 20b between the outermost side walls adjacent to the frame structure and the cooling tower inner wall may as previously mentioned be filled with a pressure-resistant filling, e.g. a suitable foamed plastic.

The latter arrangement offers an advantage in that it is also possible to transmit forces which are caused by a positive pressure in the elements. Such a design enables the heat exchange elements to be operated at a positive pressure and, alternatively, at a negative pressure. Filling of the cavities 20a, 20b with the filling compound additionally ensures effective sealing so that leakage of air is prevented. The cross section of the cooling tower in the area where the heat exchange elements 2 nearly fill the cross section is preferably square. However, the cross section may, for example, be rectangular or of a similar shape.

In the preferred embodiment shown in FIG. 9 the arrangement is not with several heat exchange elements 2 in series but each heat exchange element is separately connected in the circuit of the heat exchange medium. In order to create favourable heat exchange conditions for the heat exchange medium in the form of a liquid fluid, horizontal or substantially horizontal partitions are provided within a heat exchange element to guide the heat exchange medium, one of the partitions being shown at 6' in FIG. 9. The partitions are also required if the heat exchange medium in the form of a gas has to be cooled. These partitions 6' are omitted if the heat exchange medium enters the heat exchange element in the form of vapour to be condensed in the element.

FIG. 13 shows a family of characteristic curves of heat exchange elements according to the invention plotted in a right angle cartesian graph. These heat exchange elements were the subject of tests. The principal data in this connection were: height (=length of tubes 5): 0.5 to 4 m; the width and length being arbitrary; non-finned tubes with an inside diameter of 20 mm; wire helices as turbulence-inducing means with 0.6 mm wire diameter and 50 mm pitch of the wire helix.

Plotted on the abscissa of the graph is the flow velocity $w_A$ of the air immediately ahead of the inlet into the cooling tubes in m/s (meters per second); plotted on the ordinate of the graph is the specific heat transfer rate $k_A$ in kcal/m$^2$hK (kilocalories per square meter, hour and degree Kelvin) with regard to an area of attack of one square meter.

For the different lengths L of the air conveying tubes 5, the curves $\alpha_1$, $\alpha_2$, $\alpha_3$, $\alpha_4$, $\alpha_5$, and $\alpha_6$ are obtained. The curve $\alpha_1$ was obtained with tubes of 0.5 m length; the curve $\alpha_2$ with L=1.0 m; $\alpha_3$ with L=1.5 m; $\alpha_4$ with L=2.0 m; $\alpha_5$ with L=3.0 m and $\alpha_6$ with L=4.0 m.

Also plotted in the graphs are the curves $\beta_1$ to $\beta_{10}$; the curves $\beta$ indicate the pressure loss $\Delta p$ in mm w.c. (water column)—measured as the differential pressure between the air inlet and air outlet. The curves $\beta_1$ to $\beta_{10}$ are the curves with $\Delta p$ of 1 mm water column to $\Delta p$ 10 water column.

With a view to explaining the progress in the heat exchange elements according to the invention, a value has been entered in the graph—denoted by o—which derives from a commercial design of finned tube heat exchange elements whose finned tubes have coolant flowing in them and which are placed in a cross flow of air. The commercial heat exchange elements originate from the rope-net type dry cooling tower of the Schmehausen nuclear power station. Using the data of that installation, we have determined a $k_A$ value of 3340 kcal/m$^2$hK and a $\Delta p$ value of 8.3 mm w.c. and entered these in the graph. If we draw a straight lines $g_1$ parallel to the abscissa from this point 0 to the left, then it will be found that it is possible with the heat exchange element according to the invention to achieve, for example, a pressure loss of about 2 mm w.c. (=water column) with a given heat transfer rate if the height of the heat exchange element is 3 m and inlet flow velocity about 1 m/sec. In other words, the heat exchange element design according to the invention permits the same amount of heat to be dissipated per unit time with a Δp value that is about 4 times lower. Since the Δp value in turn is decisive for the height of the cooling tower, the heat exchange element according to the invention permits cooling tower heights to be obtained that are, for instance, about 4 times lower than the cooling tower height of the commercial cooling tower of the Schmehausen nuclear power station, if the length of the cooling tubes (=height of the heat exchange elements) and the air inlet flow velocity are suitably selected. It is obvious that, because of lesser complexity and lower price, the lower cooling tower weights are an advantage. Furthermore, lower cooling tower heights are considered to be less objectionable in the landscape.

On the other hand, it is possible to interpret the graph to the effect that—assuming equal cooling tower dimensions and equal Δp value—it is possible to conceive a heat exchange element starting from the point o and working upwards from the appropriate Δp curve $\beta_o$ in the direction of the arrow which, for example, results at a substantially higher $k_A$-value of about 7400 kcal/m²hK at 3 m height. This means that if one were to install heat exchange elements with a height of 3 m and an inlet air flow velocity of 2.4 m/s in the commercial cooling tower (300 MW Uentrop-Schmehausen power station), the heat exchanger according to the invention would handle a heat dissipation increased by about the factor 2.2. Again this goes to illustrate what great advantage is afforded by the heat exchanger according to the invention.

Another example of a commercial steam power station with conventional heat exchanger equipment is symbolized by x in FIG. 13; this is the Grootvlei station in the Union of South Africa.

FIG. 14 plots the specific heat transfer rate $k_A$ in a right angle cartesian graph as a function of height of tower shell with different tube length L=0.5 m to L=4 m. Plotted on the ordinate of the graph are the specific heat rate $k_A$ in W/m₂K (Watts per square meter and degree Kelvin) with regard to one square meter of area of attack whereas the height of the tower shell in m (meters) is plotted on the abscissa. Curves $k_A$=f (H) are shown in the graph for different tube lengths of L=0.5 m to L=4 m. These curves are numbered $\delta_1$ to $\delta_6$. The curve $\delta_1$ is allied to the tube length L=0.5 m; accordingly, $\delta_2$ is allied to the tube length L=1.0 m; $\delta_3$ to the tube length L=1.5 m, $\delta_4$ to the tube length L=2.0 m, $\delta_5$ to the tube length L=3.0 m and $\delta_6$ to the tube length L=4.0 m (m=meters).

It has been empirically determined that the curves δ satisfy at least approximately the equation $$k_A = 382 \cdot L^{0.48} \cdot \left[ H \cdot \frac{(\gamma_1 - \gamma_2)}{0,1} \right]^{0.53}$$

In this equation, we enter the length L of the tubes in meters, the height of the tower shell in meters, the specific gravity γ of the air in kg/m³; for the magnitude $k_A$ of the calculated result the unit W/m² k (Watts per square meter and degree Kelvin) has to be inserted.

The graph shown in FIG. 14 has been developed from the graph shown in FIG. 13 inasmuch as the $k_A$-values and Δp-values belonging to the corresponding α-curves have been transferred into the new graph. Only the $k_A$-values have been multiplied by the factor of 1.163 for the purpose of conversion into W/m²K, and the corresponding Δp-values have been converted according to the known formula $\Delta p = g \cdot H(\gamma_1 - \gamma_2)$ into heights of the tower shell. (In this expression g denotes acceleration due to gravity, H height of tower shell, $\gamma_1$, $\gamma_2$ the specific gravities of the air immediately at the inlet into the heat exchanger and at the level of the tower shell top). To simplify the calculation, the value of $(\gamma_1 - \gamma_2)$ has been approximated to 0.1 kg/m³.

Projected into this graph have been again the commercial heat exchangers with finned tubes (Schmehausen power station o; Grootvlei x) analogously to FIG. 13 and $(\gamma_1 - \gamma_2)$ has in this case also been approximated to 0.1 kg/m³.

The graph shows that the heat exchanger according to the invention is superior to these commercial designs with respect to tower dimensions or heat transfer rate if the length of the tubes is 0.8 m and more.

The use of the abovementioned equation $k_A$=f (H) in conjunction with the orthodox equations (with which someone versed in the art is familiar) is explained in the following.

A conversion or resolution of the equation $$k_A = 382 \cdot L^{0.48} \cdot \left[ H \cdot \frac{(\gamma_1 - \gamma_2)}{0.1} \right]^{0.53}$$

for the tower shell height H gives the equation:

$$H = e^{189 \ln} \left[ \frac{k_A}{382 \cdot (L)^{0.48} \frac{(\gamma_1 - \gamma_2)}{0.1}^{0.53}} \right] \quad (1)$$

where e and ln have the meaning commonly attached to them in mathematics (ln is the symbol for the logarithmus naturalis; e the symbol for an exponential function).

Further expressions are:

$$Q = k_A \cdot \Delta\theta_m \cdot A_A \quad (2)$$

$$A_A = \frac{\pi \cdot D^2}{4} \quad (3)$$

where $A_A$ is the area of attack at the inlet of the air into the tubes in m²

D the diameter of the tower shell at the level of its lower edge in meters

Q the heat transfer rate in W $\Delta\theta_m$ the mean logarithmic temperature difference between the medium to be cooled and the air in K (K=Kelvin) $k_A$ the specific heat transfer rate in W/m²K and $\pi$=3.14159 . . .

Substituting the equation (3) in the equation (2) and resolving it for $k_A$, we then find:

$$k_A = \frac{Q}{\Delta\theta_m \cdot \frac{D^2\pi}{4}} \quad (4)$$

Substituting the equation (4) in equation (1), one obtains:

$$H = e^{1.89\ ln}\left[\frac{Q}{300 \cdot D^2 \cdot L^{0.48} \cdot \Delta\theta_m \cdot \frac{(\gamma_1 - \gamma_2)}{0.1}^{0.53}}\right] \quad (5)$$

Where Q, D, H, L, $\Delta\theta_m$, $\gamma_1$, $\gamma_2$, have the same meanings and are the same units as indicated further above in the specification.

If, in designing a heat exchanger, the magnitudes Q, $\gamma_1$, $\gamma_2$ and $\Delta\theta_m$ are assumed to be given (e.g. $Q=438 \cdot 10^6$ W; $\gamma_1=1.233$ kg/m$^3$; $\gamma_2=1.152$ kg/m$^3$ and $\Delta\theta_m=10.55$ K), then the equation (5) yields appropriate values H for different values of D and L. Basing on the information so obtained, which preferably is represented in the form of a table, the combinations of H, D and L are selected which represent the optimum from the points of view of economy and cost. Basing on the aforementioned numerical values of Q, $\gamma$, $\Delta\theta_m$ which should be looked upon only as examples the at least approximately optimum solution is arrived at if D=140 m, L=180 m and H=30 m.

The heat exchanger according to the invention is not limited to the embodiments represented and described in the foregoing, but also encompasses any modifications within the scope of the appended claims.

For instance, the end walls (e.g. plates 3) may be arranged at least substantially vertical, when the tubes 5 would be horizontal or substantially horizontal.

In the case of horizontal or substantially horizontal end plates (top and bottom wall) a single heat exchange element consisting essentially of end walls, side walls and tubes may be arranged in the cooling tower or similar envelope.

The heat transfer medium may be turbine exhaust steam.

The heat exchanger may be both of the natural draught and mechanical draught type.

The partitions may be formed in a different manner than by the intermediate plates (6) referred to.

The term "indirect" recooling of a heat transfer medium by means of air as used in the application is defined to mean that the heat transfer medium dissipates the heat through the tube walls to the air, i.e. is not in direct contact with the air.

The term "heat exchanger" is intended to include both the heat exchange element or elements and the cooling tower structure or similar plant.

What we claim is:

1. A natural draught dry cooling tower with a tube heat exchanger for indirect recooling of a heat transfer medium by a gaseous medium having a considerably lower heat transfer coefficient than does said heat transfer medium, especially water by air, for use with a draught generating shell of a plant, which comprises at least one heat exchange element which includes:

two substantially parallel first wall means which are spaced from each other and are respectively provided with holes;

second wall means associated with said two first wall means so as to define a heat exchange region with said two first wall means;

inlet and outlet means for conveying said heat transfer medium into and out of said heat exchange region respectively; and tube means with maximum transfer surfacing sealingly extending through the respective holes of said two first wall means for conveying gaseous medium through said tube means which are free of any ribs to avoid pressure loss in the natural draught dry cooling tower, the design thereof being governed by the equation $$k_A = 382 \cdot L^{0.48} \cdot [(H \cdot (\frac{\gamma 1 - \gamma 2}{0.1})]^{0.53},$$

in which L designates the length of said tube means individually in meters, H the height of said tower shell in meters $\gamma_1$ the specific gravity of said gaseous medium directly before the inlet into said heat exchanger in kg/m$^3$ (kilograms per cubic meter, $\gamma_2$ the specific gravity of said gaseous medium at the level of the top of said tower shell in kg/m$^3$, and $k_A$ the specific heat transfer rate in W/m$^2$K (Watts per square meter area of attack and degrees Kelvin).

2. A cooling tower according to claim 1 in which L is at least equal to 0.8 meter.

3. A cooling tower according to claim 2, in which said tube means comprises a plurality of individual tubes having an inner diameter in a range of from 10 to 50 mm.

4. A cooling tower according to claim 3, in which said tube means comprises a plurality of individual tubes having a wall thickness in a range of from 0.3 to 1 mm.

5. A cooling tower according to claim 4, in which said tube means comprises a plurality of individual tubes spaced from one another by 0.5 to 2 mm for withdrawing heat from said heat transfer medium when the latter is present in said heat exchange region in liquid form.

6. A cooling tower according to claim 4, in which said tube means comprises a plurality of individual tubes spaced from one another by 2 to 5 mm for withdrawing heat from said heat transfer medium when the latter is present in said heat exchange region in a vaporous form.

7. A cooling tower according to claim 4, in which said tube means comprises a plurality of parallel individual tubes having first ends arranged adjacent to each other and having second ends arranged adjacent to each other, at least said first ends being hexagonal, the sides of adjacent hexagonal ends being sealingly interconnected.

8. A cooling tower according to claim 7, which includes laminar-boundary-layer-initiating turbulence-inducing means in said tube means.

9. A cooling tower according to claim 8, in which said turbulence-inducing means project inwardly from the inside of said tube means repeatedly effective in throttling.

* * * * *